United States Patent [19]

Spencer et al.

[11] Patent Number: 4,964,824

[45] Date of Patent: Oct. 23, 1990

[54] SWIMMING GLOVE

[76] Inventors: Kevin F. Spencer; Bonnie L. Spencer, both of P.O. Box 3019, Stateline, Nev. 89449

[21] Appl. No.: 361,252

[22] Filed: Jun. 5, 1989

[51] Int. Cl.[5] ..... A63B 31/04

[52] U.S. Cl. ..... 441/57

[58] Field of Search ..... 441/56, 57, 58

[56] References Cited

U.S. PATENT DOCUMENTS

| | | | |
|---|---|---|---|
| 4,058,863 | 11/1977 | Ferdico | 441/57 |
| 4,067,081 | 1/1978 | Drescher | 441/57 |
| 4,121,312 | 10/1978 | Penney | 441/57 |
| 4,345,335 | 8/1982 | Shih-Li | 441/57 |
| 4,548,588 | 10/1985 | Kosuge | 441/57 |
| 4,618,328 | 10/1986 | Chi | 441/58 |
| 4,669,991 | 6/1987 | Southworth | 441/57 |
| 4,746,313 | 5/1988 | Bray et al. | 441/58 |

*Primary Examiner*—Sherman Basinger
*Attorney, Agent, or Firm*—Leon Gilden

[57] ABSTRACT

A swimming glove is set forth including a back and palm surface securable together utilizing first and second zipper members with forwardly extending finger sheaths formed with openings to enable the fingers of an individual to extend therethrough. The sheaths include a webbing therebetween with each webbing including a tapered bore to receive a tapered alignment tab securable to a further webbing portion forming part of a forwardly extending and mountable cap member. The cap member includes individual caps of conical configuration for enclosing the associated fingers wherein each cap member further includes an inwardly extending annular ridge for securably receiving an outwardly extending annular locking ring formed on the outer terminal edges of each sheath.

2 Claims, 1 Drawing Sheet

SWIMMING GLOVE

BACKGROUND OF THE INVENTION

1. Field of the Invention

The field of invention relates to swim gloves, and more particularly relates to a new and improved swim glove utilizing a cap member releasably mounted to a swim glove to vary the effective length of webbing defined between the finger sheaths of the swim glove.

2. Description of the Prior Art

The use of swim gloves is well known in the prior art. Swim gloves are utilized to enhance the effective surface area of a swimmer to enhance the movement of a swimmer through a water medium. Swim gloves of the prior art utilize webbing of a length less than the finger length of an individual to enable manual dexterity and enhanced sense of touch during use in water sports requiring availability of these sensations. The use of full length finger webbing is desirable to provide maximum surface area provided a swimmer during water maneuvers, such as rescue operations, swimming in rough waters, or enhanced resistance to increase body strength for swimming.

The prior art has heretofore not provided the availability of a glove providing both a reduced finger sheath length and selectively providing a full length swim glove, as set forth in the instant invention. For example, U.S. Pat. No. 4,121,312 to Penney sets forth a swimming glove utilizing a full enclosing finger sheath arrangement with fully extending webbing therebetween to provide enhanced swimming capability for an individual. The glove includes a flotation collar about the wrist for buoyancy.

U.S. Pat. No. 4,345,335 to Shih-li sets forth a full length finger sheath glove with included webbing therebetween wherein the tip structure of the sheaths are formed with an opening to alleviate stress and strain as a finger is forced into the sheath.

U.S. Pat. No. 4,618,328 to Chi sets forth a swim glove formed with an opened palm and back of the hand to enhance securement of the glove to a wearer with openings formed at the finger tips of the glove and about the knuckle portions of the sheaths to provide enhanced flexibility and mobility to fingers presented therewith.

U.S. Pat. No. 4,669,99I to Southworth provided with a swim glove formed with sheaths of open ends to enable projection of the fingers therethrough with webbing formed between the reduced length sheaths to enhance swimming effectiveness to a user.

U.S. Pat. No. 746,313 to Bray sets forth a webbed swimming glove formed of two planar sheets secured together with a first sheet of elastic mesh material and a second sheet of thin stiff water impermeable material. The truncated finger sheaths are formed with stitching or sealing regions about the upper ends of the sheets to provide the desired integrity of the glove.

As such, it may be appreciated that there is a continuing need for a new and improved swimming glove wherein the same addresses both the problems of flexibility of application and ease of use, and in this respect, the present invention substantially fulfills this need.

SUMMARY OF THE INVENTION

In view of the foregoing disadvantages inherent in the known types of swimming gloves now present in the prior art, the present invention provides a swim glove wherein the same may be secured to an individual hand as desired with a cap member extension selectively securable to the swim glove to effectively lengthen the effective surface area of the swim glove in use. As such, the general purpose of the present invention, which will be described subsequently in greater detail, is to provide a new and improved swim glove which has all the advantages of the prior art swimming gloves and none of the disadvantages.

To attain this, the present invention comprises a swimming glove formed with zippered sides to enhance securement of the glove to an individual and further formed with truncated sheaths at a lowermost part of the swim glove to enable securement of the swim glove overlying a hand of an individual. A cap member extension is provided with conical blind caps for securement over the truncated sheaths of the swim glove utilizing encircling ridges within the conical caps coupling with outward extending rings of the finger sheaths to enable securement of the swim glove and the extension together. Further, alignment tabs formed between the caps of the cap member extend rearwardly to be received within tapered blind bores formed within connecting webs of the swim glove to align the web members of the swim glove and the cap member together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swimming glove which has all the advantages of the prior art swimming gloves and none of the disadvantages.

It is another object of the present invention to provide a new and improved swimming glove which may be easily and efficiently manufactured and marketed.

It is a further object of the present invention to provide a new and improved swimming glove which is of a durable and reliable construction.

An even further object of the present invention is to provide a new and improved swimming glove which is susceptible of a low cost of manufacture with regard to both materials and labor, and which accordingly is then susceptible of low prices of sale to the consuming pubic, thereby making such swimming glove economically available to the buying public.

Still yet another object of the present invention is to provide a new and improved swimming glove which provides in the apparatuses and methods of the prior art some of the advantages thereof, while simultaneously overcoming some of the disadvantages normally associated therewith.

Still another object of the present invention is to provide a new and improved swimming glove wherein the same is formed as a swim glove with a forwardly securable cap member to selectively lengthen the effective surface area of the swim glove, as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
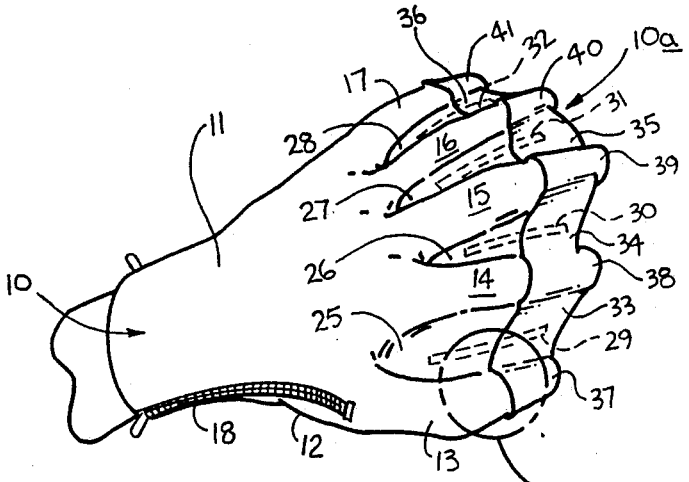
FIG. 1 is an isometric illustration of the instant invention with the swim glove and cap member secured together.
Figure 4:
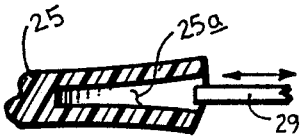
FIG. 4 is an orthographic view taken along the lines 4—4 of FIG 3 in the direction indicated by the arrows.
Figure 2:
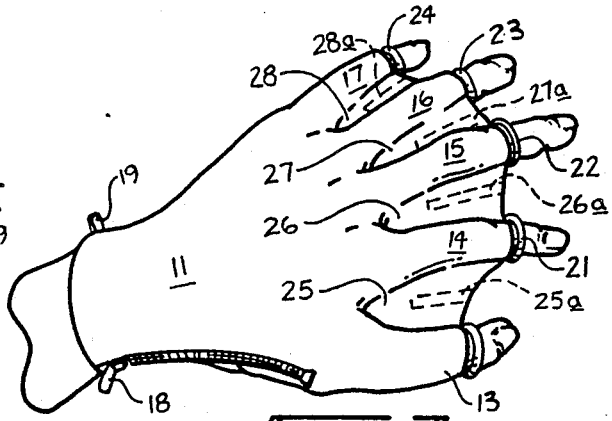
FIG. 2 is an isometric illustration of the swim glove of the instant invention.

With reference now to the drawings, and in particular to FIGS. 1 to 4 thereof, a new and improved swimming glove embodying the principles and concepts of the present invention and generally designated by the reference numeral 10 will be described.

Figure 3:
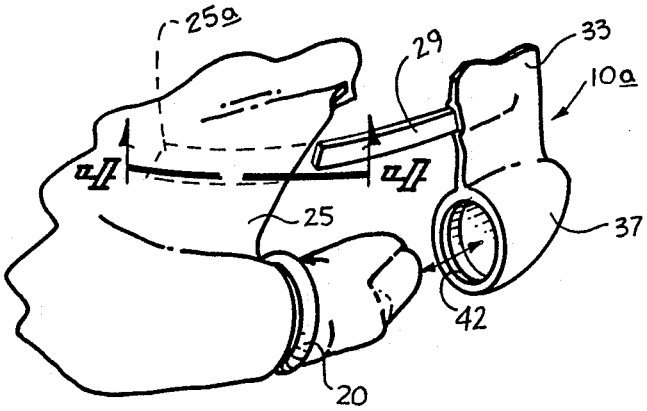
FIG. 3 is an isometric illustration of section 3, as set forth in FIG. 1.

More specifically, it will be noted that the swimming glove 10 of the instant invention substantially comprises a swim glove including a back surface 11 with an opposite palm surface 12 to provide an enclosable glove to receive a user's hand therewithin. The glove includes a first truncated thumb sheath 13, a second truncated index finger sheath 14, a third truncated middle finger sheath 15, a fourth truncated ring finger sheath 16, and a fifth truncated little finger sheath 17. The interface of the back surface 11 and palm surface 12 are formed with a first elongate side zipper 18 aligned with the side of the glove 10 and the first thumb sheath 13. The second elongate side zipper 19 is positioned aligned with the side of the glove 10 at the opposite side of the first zipper 18 and aligned with the fifth little finger sheath 17. Each of the finger sheaths 13 through 17 terminates in a locking ring extending outwardly and encircling the terminal end of the respective truncated finger sheaths 13 through 17 comprising a first locking ring 20, a second locking ring 21, a third locking ring 22, a fourth locking ring 28, and a fifth locking ring 24 encircling the terminal ends of the respective first finger sheath 13, second finger sheath 14, third finger sheath 15, fourth finger sheath 16, and fifth finger sheath 17. The locking ring and the construction of the glove comprises a flexible polymeric material illustrated with a rubber cross-sectional indication, but may be formed of any suitable material from the family of polymeric materials including natural or synthetic non-woven materials. A thin flexible connecting web is formed between each of the finger sheaths 13 through 17 comprising a first connecting web 25 formed between the first and second finger sheaths 13 and 14, a second connecting web 26 integrally formed and secured to the second and third finger sheaths 14 and 15, a third connecting web 27 secured to and enclosing the sides of the third and fourth finger sheaths 15 and 16, and a fourth connecting web 28 secured to the fourth and fifth finger sheaths 16 and 17. Each of the connecting webs 25 to 28 have a respective tapered blind bore formed medially thereof including a first blind bore **25*a*, a second blind bore 26*a*, a third blind bore 27*a*, and a fourth blind bore 28*a*. The blind bores are configured and arranged to receive outwardly extending alignment tabs depending outwardly and orthogonally relative to the forwardly and releasably mounted cap member 10*a* that are selectively securable to the forward ends of the finger sheaths 13 through 17 by use of the respective locking rings 20 through 24. The alignment tabs defined as a first alignment tab 29, a second alignment tab 30, a third alignment tab 31, and a fourth alignment tab 32 are each secured integrally to and extending outwardly of respective connecting webs of the cap member 10*a* including a fifth connecting web 33, a sixth connecting web 34, a seventh connecting web 35, and an eighth connecting web 36 wherein the connecting webs join the conically tapered enclosing caps indicated as first cap 37, second cap 38, third cap 39, fourth cap 40, and fifth cap 41 to securably receive the locking rings 20 through 24 respectively of the finger sheaths 13 through 17 respectively. Each of the enclosing caps 37 through 41 include an encircling inwardly extending ridge 42, as illustrated in FIG. 3, formed of flexible material to receive the locking rings therewithin and secure the caps 37 through 41 to the respective finger sheaths 13 through 17. The cap member 10*a* is also formed of the same flexible material as the main body of the swim glove 10**.

In this manner, a user of the device may selectively provide a swim glove of a first length utilizing only the swim glove portion 10 to provide manual dexterity and a sense of touch in use of the glove while inclusion and securement of the releasable cap member **10*a* to the swim glove 10** provides full length webbing for effecting an increased surface area to enhance use of the glove in forms such as rough water, rescue operations, and utilization by strong swimmers.

It is understood that the alignment tabs 29 through 32 are formed of a relatively rigid material and are frictionally retained within the complementarily configured blind bores **26*a* through 28*a*. The alignment tabs in association with the blind bores maintain alignment of the forward connecting webs of the cap member 10*a* with the connecting webs of the glove 10**.

It should be understood also that the use of the first and second zippers 18 and 19 allow the sides of the glove, and particularly the back surface and the palm surface 11 and 12 respectively, to be spread relative to one another to enable enhanced ease of securement of the glove to a user's hand. The use of the zippers 18 and 19 are not mandatory and may be deleted, but are desirable to increase the ease of operation of the glove and securement onto the individual. It is further understood that the glove is made in matching pairs, whereas only the left is illustrated but the right hand understandably is simply a mirror image of the left hand and its illustration is not deemed necessary. Further, the finger sheaths 13 through 17 terminate in an opening substantially equal to the cross-sectional opening of the respective finger sheaths to enable the fingers of an individual to extend therethrough.

As to the manner of usage and operation of the instant invention, the same should be apparent from the above disclosure and accordingly no further discussion relative to the manner of usage and operation of the invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A webbed swimming glove comprising, a plurality of finger sheaths defining a conduit for reception of individual fingers of a user, and each of said finger sheaths extend forwardly of a hand portion, said hand portion including a back surface overlying and connected to a palm surface, and each of said finger sheaths terminating in an opening substantially equal to the cross-sectional area of a respective finger sheath, and wherein said plurality of finger sheaths includes a first finger sheath, a second finger sheath, a third finger sheath, a fourth finger sheath, and a fifth finger sheath with a first connecting web formed between said first and second finger sheath, a second connecting web formed between said second and third finger sheath, a third connecting web secured between said third and fourth finger sheath, and a fourth connecting web secured between said fourth and fifth finger sheath, and wherein each of said connecting webs includes an inwardly extending tapered blind bore, and wherein each finger sheath includes a cap member configured as a conically tapered enclosing cap to include a first cap and a second cap with a fifth connecting web therebetween, the second cap and a third cap include a sixth connecting web therebetween, and the third cap and a fourth cap include a seventh connecting web therebetween, and the fourth cap and fifth cap include an eighth connecting web therebetween, and each of the fifth, sixth, seventh, and eighth connecting webs including a respective alignment tab directed outwardly thereof with each respective alignment tab receivable within the blind bore of each of said connecting webs.

2. A webbed swimming glove as set forth in claim 1 wherein each of the finger sheaths terminate in an outwardly extending locking ring receivable within each of the enclosing caps wherein the enclosing caps each include an encircling inwardly extending ridge to receive the locking rings therethrough and secure the enclosing caps to the associated finger sheaths.

* * * * *